United States Patent [19]

James

[11] 3,936,540

[45] Feb. 3, 1976

[54] HOT DIP GALVANISING

[75] Inventor: Ian James, Birmingham, England

[73] Assignee: Foseco International Limited, Birmingham, England

[22] Filed: June 12, 1974

[21] Appl. No.: 478,830

[30] Foreign Application Priority Data

July 12, 1973 United Kingdom..... 33313/73

[52] U.S. Cl. ..... 427/310; 427/433; 427/435; 427/436

[51] Int. Cl.[2]..... C23C 1/00

[58] Field of Search..... 117/114 A, 51, 52; 427/310, 433–436

[56] References Cited

UNITED STATES PATENTS

| | | | |
|---|---|---|---|
| 1,965,760 | 7/1934 | Baldwin | 117/52 |
| 2,723,449 | 11/1955 | Miller | 148/26 |
| 3,577,560 | 5/1971 | Lawrence | 148/26 |

*Primary Examiner*—Mayer Weinblatt
*Assistant Examiner*—Edith R. Buffalow
*Attorney, Agent, or Firm*—Cushman, Darby & Cushman

[57] ABSTRACT

In wet process hot dip galvanising use is made of a flux which melts at below 500°C and consists of 30 – 70% by weight magnesium chloride and 20 – 70% by weight sodium chloride and/or potassium chloride.

7 Claims, No Drawings

HOT DIP GALVANISING

This invention concerns the hot dip galvanising of ferrous metals.

In hot dip galvanising, ferrous metals or alloys, particularly cast iron and mild steel, are treated to prevent corrosion. The hot dip galvanising process involves dipping a ferrous metal article having a surface which is chemically clean, into molten zinc, which may contain minor quantities of other elements, in order to coat the surface of the article with a protective layer of zinc. The coating formed adheres as a result of alloying taking place at the ferrous metal-zinc interface. As alloying cannot take place unless the surface of the article being coated is chemically clean, the cleaning cycle is an extremely important part of the hot dip galvanising process.

Normally the initial steps in the cleaning cycle can include degreasing, for example using trichloroethylene vapour or aqueous alkaline solutions, and possibly shot or grit blasting. Acid pickling then follows and the final stage is usually flux treatment using a salt or a mixture of salts. As the fluxing treatment usually immediately precedes galvanising it is this step which most ensures wetting of the surface being coated by the molten zinc.

Initially in the hot dip galvanising process the fluxing material was provided by iron salts which remained on the ferrous metal surface after pickling. The more recent process, of which there are two main types, employ a separate fluxing agent, and differ from each other in the manner in which the fluxing agent is applied. In the "Wet Process" the ferrous metal article is pickled, sometimes rinsed, and then dipped into molten zinc through a layer of molten flux floating on the surface of the zinc. In the "Dry Process" a layer of flux is applied to the surface of the ferrous metal article to be galvanised before the article is dipped into molten zinc. Application is by applying a solution of fluxing agent to the surface and drying the article to leave the flux coating on the surface. The wet and dry processes may be used together, i.e. first a flux is dried on to the surface of the article and then the article is dipped into the molten zinc bath through a layer of molten flux.

Fluxing agents commonly used in hot dip galvanising processes are ammonium chloride, zinc chloride, physical mixtures of the two, and also a chemical combination in the form of zinc ammonium chloride. These fluxing agents may be mixed with one or more alkali metal chlorides.

Most known fluxing agents suffer from the disadvantage that they evolve copious obnoxious fume, and although the addition of alkali metal chlorides reduces the quantity of fume evolved such practice may also result in a reduction of flux efficiency.

Due to the introduction of more and more stringent environmental regulations and since hot dip galvanising is in general likely to be carried out at higher temperatures than formerly, with the probable replacement of the usual metal galvanising baths by refractory lined baths, the use of fluxes which give rise to little or no fume is becoming increasingly important.

It has now been found that hot dip galvanising by the wet process may be carried out with little fume evolution using a flux containing essentially magnesium chloride together with sodium chloride and/or potassium chloride, and optionally calcium chloride.

According to the present invention there is provided a method of hot dip galvanising a ferrous metal article which comprises passing the article into molten zinc through a molten flux disposed on the surface of the zinc, and subsequently removing the article from the molten zinc, said flux melting below 500°C and comprising 30 – 70% by weight magnesium chloride, and 20 – 70% by weight sodium chloride and/or potassium chloride. Preferably the flux melts below 460°C. The flux may also contain up to 20% calcium chloride.

Other chlorides may be present, for example, aluminium chloride, lead chloride, zinc chloride, ammonium chloride, and zinc ammonium chloride, either used alone or in combination. However, since these chlorides tend to increase the amount of fume evolved they should not constitute more than 20% by weight of the total composition.

The preferred magnesium chloride content (as $MgCl_2$) is 40 – 60% by weight, the preferred sodium and/or potassium chloride content is 30 – 60% by weight, and the preferred calcium chloride content is 0 – 10% by weight.

The flux compositions may also contain frothing agents, which are often desirable in the wet process of hot dip galvanising for increasing the thickness of the layer of flux floating on the surface of the molten zinc. Materials which slowly decompose at the temperature of the hot dip galvanising bath are suitable as frothing agents. Examples include tallow, sawdust, glycerin and various resins.

Using the flux compositions of the invention hot dip galvanising may be carried out with little fume evolution over a wide range of operating temperatures.

The following examples will serve to illustrate the invention:

EXAMPLE 1

A flux composition was prepared having the following composition by weight:

| | |
|---|---|
| magnesium chloride | 50% |
| sodium chloride | 30% |
| potassium chloride | 20% |

Ferrous metal articles were shot blasted, pickled in 15% hydrochloric acid, rinsed in water and dried. The articles were then immersed in molten zinc at 450° – 460°C through a ½ inch blanket of the above flux disposed on the surface of the zinc. The immersion time was 3 – 4 minutes. No fume was evolved. After removal from the zinc, quenching and swilling the galvanised articles exhibited a bright even finish.

EXAMPLE 2

A flux composition was prepared having the following composition by weight:

| | |
|---|---|
| magnesium chloride | 40% |
| sodium chloride | 30% |
| potassium chloride | 25% |
| calcium chloride | 5% |

Ferrous metal articles were galvanised by immersion through a layer of the above flux into molten zinc using the procedure described in Example 1. The temperature of the zinc was 530° to 540°C, and the immersion time was 1 – 2 minutes. Little fume was evolved. After removal from the zinc, quenching and swilling, the galvanised articles exhitibed a bright even finish.

EXAMPLE 3

A flux composition was prepared having the following composition by weight:

| | |
|---|---|
| magnesium chloride | 60% |
| potassium chloride | 40% |

The flux was used in the galvanising of ferrous metal articles using the procedure described in Example 2 except that the temperature of the molten zinc was 525°C and the immersion time was 1 – 2 minutes.

EXAMPLE 4

A flux composition was prepared having the following composition by weight:

| | |
|---|---|
| magnesium chloride | 50% |
| sodium chloride | 50% |

The flux was used in the galvanising of ferrous metal articles using the procedure in Example 2 except that the temperature of the molten zinc was 550°C and the immersion time was 1 – 2 minutes.

I claim as my invention:

1. In the method of hot dip galvanising a ferrous metal article which comprises passing the article into molten zinc through a molten flux disposed on the surface of the zinc, and subsequently removing the article from the molten zinc, the improvement which comprises using a flux melting below 500°C and consisting essentially of 30 – 70% by weight magnesium chloride and 20 – 70% by weight of at least one compound selected from the class consisting of sodium chloride, potassium chloride and mixtures thereof.

2. The method of claim 1 wherein the flux melts at below 460°C.

3. The method of claim 1 wherein the flux further contains up to 20% calcium chloride.

4. The method of claim 1 wherein the ingredients of the flux are present in the following proportions by weight:

| | |
|---|---|
| magnesium chloride | 40 – 60% |
| sodium chloride, potassium chloride, or mixtures thereof | 30 – 60% |
| calcium chloride | 0 – 10%. |

5. The method of claim 4 wherein the flux further contains up to 20% by weight of at least one chloride selected from the class consisting of aluminum chloride, lead chloride, zinc chloride, ammonium chloride and zinc ammonium chloride.

6. The method of claim 1 wherein the flux further contains a frothing agent.

7. The method of claim 6 wherein the frothing agent is selected from the class consisting of tallow, sawdust and glycerin.

* * * * *